United States Patent [19]

Pearsall

[11] 4,351,066

[45] Sep. 28, 1982

[54] DUAL PURPOSE JACKET

[76] Inventor: Wally Pearsall, 110 E. 9th St., Los Angeles, Calif. 90015

[21] Appl. No.: 129,346

[22] Filed: Mar. 11, 1980

Related U.S. Application Data

[63] Continuation-in-part of Ser. No. 93,377, Nov. 13, 1979.

[51] Int. Cl.[3] ..... A41D 3/02

[52] U.S. Cl. ..... 2/85

[58] Field of Search ..... 2/88, 85, 84, 108

[56] References Cited

U.S. PATENT DOCUMENTS 1,368,835 2/1921 Place ..... 2/87
2,380,909 7/1945 Jackson ..... 2/84
2,971,198 2/1961 Tomich ..... 2/84

FOREIGN PATENT DOCUMENTS 239296 10/1911 Fed. Rep. of Germany ..... 2/88
309731 4/1929 United Kingdom ..... 2/88

*Primary Examiner*—Doris L. Troutman
*Attorney, Agent, or Firm*—Lewis Anten

[57] ABSTRACT

A dual purpose jacket capable of being worn or folded and inserted into the capelette of the jacket for convenient storage during travel is disclosed. The jacket includes an elastic belt which may be used to strap the folded jacket to a person or the like during transporting of the folded jacket. A method for folding and transporting the jacket is also disclosed.

5 Claims, 8 Drawing Figures

FIG. 4
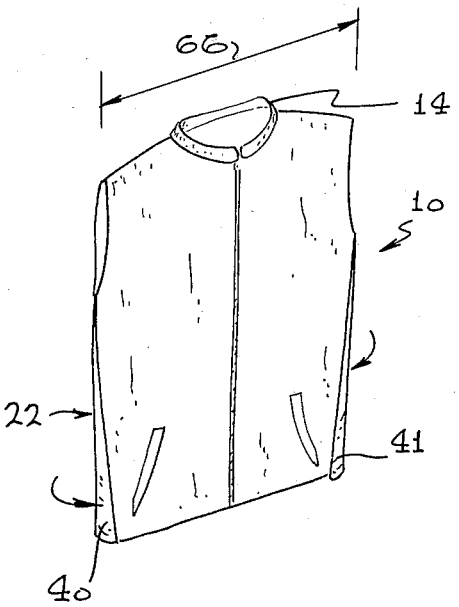
FIG. 5
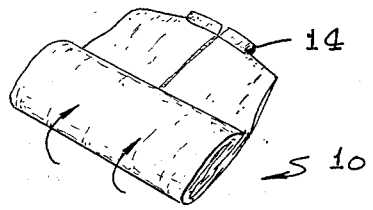
FIG. 7
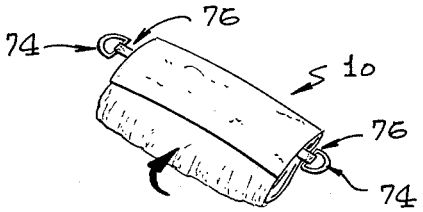
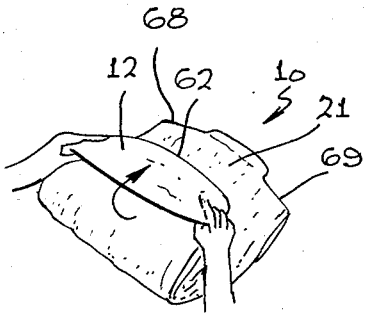
FIG. 6
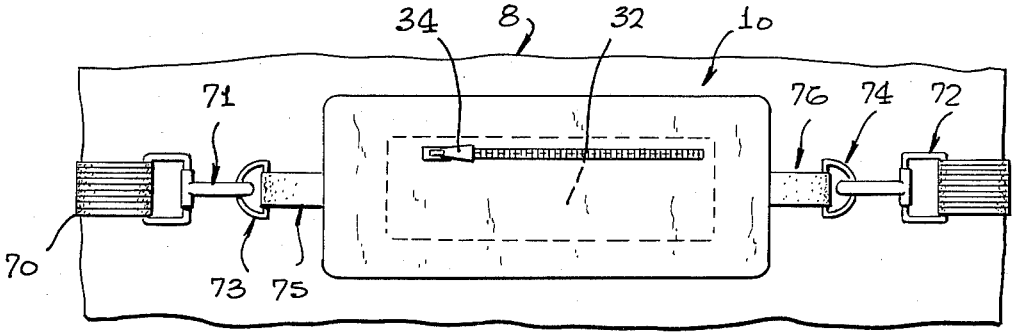
FIG. 8

DUAL PURPOSE JACKET

CROSS-REFERENCE TO RELATED APPLICATION

The present application is a continuation-in-part of co-pending application Ser. No. 93,377, filed on Nov. 13, 1979.

BACKGROUND OF THE INVENTION

The present invention relates to dual purpose jackets and more specifically to outer jackets capable of being worn or folded and strapped to a person or the like for convenient storage during travel.

Dual purpose jackets have in the past been provided with a self-contained pocket or pouch into which the jacket may be inserted for storage. Illustrative of such garments are the jackets disclosed in the following U.S. Pat. Nos.:

1,197,236: Schnur
2,058,474: Long
2,072,030: Damron
2,142,814: Fitch
2,143,931: Aronson
2,146,243: Aug
2,292,347: Bailey
2,324,722: Papierniak
2,325,494: Fayer
2,825,902: Breier
3,085,254: Cutler
4,055,853: Argento et al.
and German Pat. No. 2,208,503

One problem with these garments is that they require additional items such as zippers and pouches to contain the folded garment, items which add to the construction cost of the garment but serve no other useful purpose to the wearer of the coat. Another problem is that some of these garments have a tendency to wrinkle significantly as a consequence of the manner in which they must be folded for storage.

A still further problem with these garments is that they generally must be hand-carried, even when folded. This generally presents an unacceptable inconvenience to those jacket users, such as hikers or bicyclists, who cannot spare a free hand to carry the folded jacket.

SUMMARY OF THE INVENTION

It is an object of the present invention to provide a new and improved dual purpose jacket which does not suffer from these and other problems in the prior art.

Another object of the present invention is to provide a dual purpose jacket which can be folded and inserted for storage into the capelette of the jacket and which can maintain its storage position without the need for additional closure devices.

Another object of the present invention is to provide a dual purpose jacket which can be folded and inserted for storage into a portion of the jacket which has uses other than for the mere containment of the folded jacket.

Another object of the present invention is to provide a dual purpose jacket which, when folded, can be strapped to the body of a person or the like for convenient storage during travel.

Another object of the present invention is to provide a dual purpose jacket which can be conveniently stored for travel in a self-contained pouch in a manner which shields the outer surfaces of the jacket from dirt and other stain-producing materials.

A still further object of the present invention is to provide a method of folding and transporting an outer jacket for convenient storage and travel.

These and other objects of the present invention will be evident from a review of the following detailed description of the preferred embodiment of the present invention, read in association with the accompanying drawings.

BRIEF DESCRIPTION OF THE DRAWINGS

FIG. 4 is a perspective view of the present invention illustrating the initial step of the method for folding the jacket shown in FIG. 1.

FIG. 5 is a perspective view of the present invention illustrating the second step of the method for folding the jacket shown in FIG. 1.

FIG. 6 is a perspective view of the present invention illustrating the third step of the method for folding the jacket shown in FIG. 1.

FIG. 7 is a perspective view of the present invention illustrating the final step of the method for folding the jacket shown in FIG. 1.

FIG. 8 is a perspective view of the preferred means of the present invention used for affixing the folded jacket to a person or the like.

DESCRIPTION OF THE PREFERRED EMBODIMENTS

Figure 1:
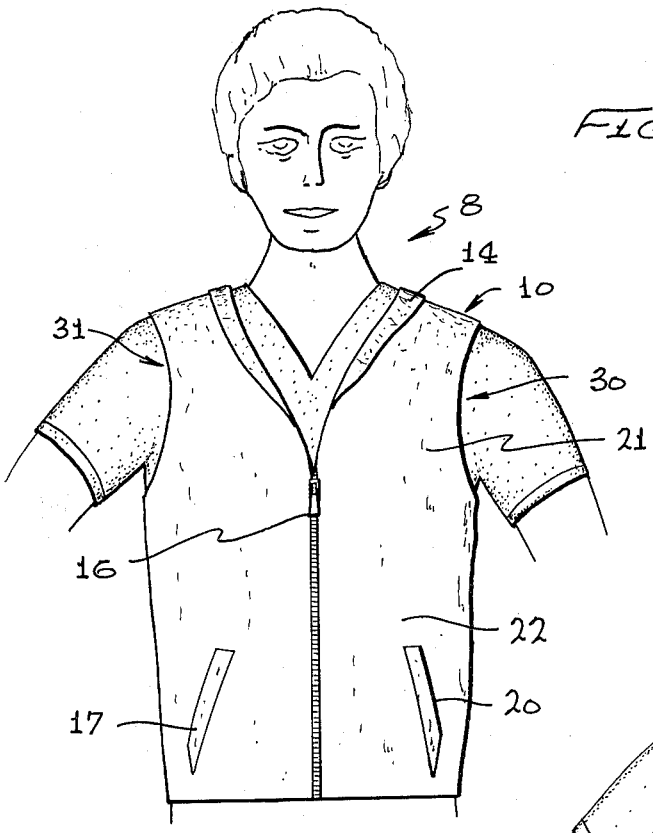
FIG. 1 is a perspective view of the front portion of a preferred embodiment of the present invention shown being worn as an outer jacket.

FIG. 1 illustrates the dual purpose jacket 10 being worn on model 8. Jacket 10, which is shown as being generally sleeveless, includes collar 14, front closure zipper 16, pockets 17 and 20, arm openings 30 and 31, upper portion 21, and lower portion 22—all constructed and joined according to conventional garment marking techniques.

Figure 3:
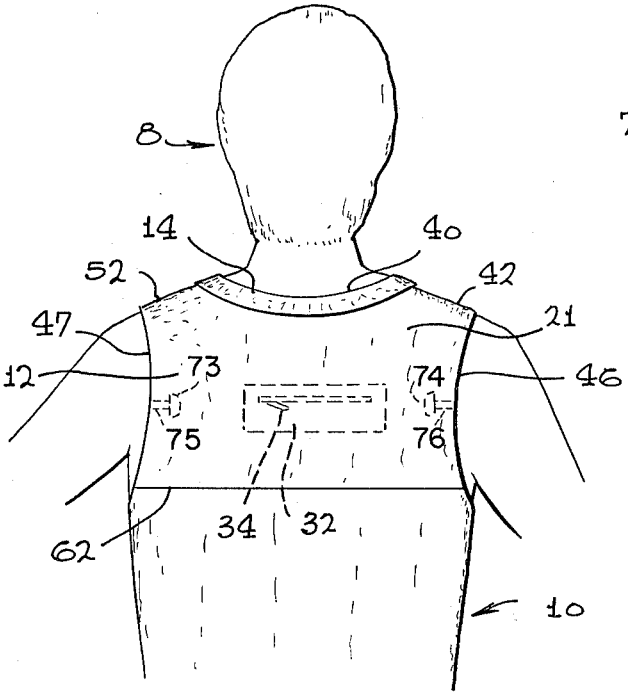
FIG. 3 is a perspective view of the back portion of the present invention illustrating the details of the capelette portion of the jacket.

Jacket 10 also includes capelette 12 as shown in FIG. 3. Capelette 12 is of special importance to the subject invention as it not only provides style, protection, and form for the jacket while it is being worn, but, as later explained, serves as a pouch-like container for the jacket during storage. To facilitate this dual function, the center portion of capelette 12's upper perimeter edge 40 is sewn to the lower portion of collar 14 along edge 40, and the outer portions of its upper perimeter edge are sewn to the top shoulder portions of jacket 10 along edges 42 and 52, respectively. Also, its lateral perimeter edges are sewn to the rear portion of arm openings 30 and 31 along edges 46 and 47, respectively. When attached as described, capelette 12 and the back of upper portion 21 form an inverted pouch. Lower end 62 of capelette 12 is not attached.

The amount of material needed for the proper construction of capelette 12 is approximately the same as the amount of material used for the back of upper portion 21. Once the upper and lateral perimeter edges of capelette 12 are sewn to jacket 10 at the places described above, capelette 12 should neither sag nor be tightly stretched while jacket 10 is being worn. Rather, it should be of the same tautness as is the back of upper portion 21. Protection against tearing may be provided by reinforcing the lateral and perimeter seams of capelette 12 with suitable means such as a double row of stitching.

Jacket 10, including capelette 12, may be formed of any conventional material such as polyester, nylon, cotton, wool or a blend of such types of materials. For best results, the material should be relatively light in weight and should not be prone to wrinkling when folded. It has been found that a quilted array of polyester fiber filler sandwiched between two relatively thin layers of material is particularly well suited for this purpose.

When it is desired to prepare jacket 10 for storage and transport, as shown in FIG. 4, collar 14 is unfolded and bottom ends 40 and 41 are folded inward so that the width of folded jacket 10 throughout its length is approximately the width of the shoulders of the jacket, a width illustrated in FIG. 4 by numeral "66".

Next, the lower end of jacket 10 is rolled upward towards collar 14 as shown in FIG. 5. The number of times the lower end must be rolled will depend upon the length of jacket 10, which, of course, will vary depending upon the particular style of jacket to which the subject invention is adopted. Once the lower end is fully rolled upward so that only collar 14 protrudes, the resulting bundle is flipped over in preparation for the final conversion step.

The pouch formed by capelette 12 and the back of upper portion 21 is then folded inside out as illustrated in FIGS. 6 and 7. In particular, lower end 62 of capelette 12 is pulled upward while shoulder corners 68 and 69 are pressed inward towards the center of the back of upper portion 21. Once lower end 62 of capelette 12 has cleared collar 14, it is pulled down over the other side of folded jacket 10 while folded jacket 10 is tucked into the inverted pouch being formed by capelette 12 and the back of upper portion 21. The resulting inverted pouch is then pressed into a generally rectangular shape.

Figure 2:
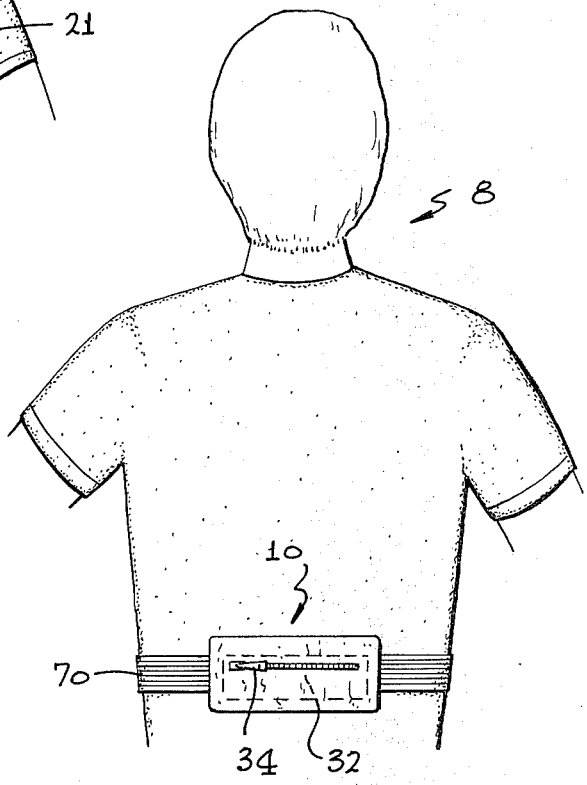
FIG. 2 is a perspective view of the present invention shown folded and attached to the body of a person.

A convenient means to store folded jacket 10 during travel is to attach it to the body of a person or the like, as shown in FIG. 2. For this purpose, and as illustrated in detail in FIG. 8, an elastic belt 70 terminating in detachable clasps 71 and 72 is provided along with D-rings 73 and 74 which are affixed to jacket 10 by material strips 75 and 76, respectively. To attach folded jacket 10 to a person or the like, elastic strap 70 is stapped around the person or the like and clasps 71 and 72 are clipped to D-rings 73 and 74, respectively, as shown in FIG. 8. Although D-rings 73 and 74 are illustrated in the preferred embodiment, other suitable retaining means such as hooks or loops may also be used.

Once folded, the resulting folded jacket requires no fastners to retain its shape. This is partly because of the unique folding process which is used and partly because of the unique structure of capelette 12 and associated back portion of upper portion 21. It should also be apparent that the surfaces of the folded jacket which are exposed to the environment are surfaces of jacket 10 which are not so exposed during the wearing of jacket 10. Thus, the outer wearing surface of jacket 10 are shielded from dirt and other stain producing materials while the jacket is folded for storage. As further protection against foreign particles, a closure such as a zipper or buttons may be added (not shown) to lower end 62 of capelette 12 to seal it against the tucked in portion of folded jacket 10 while the jacket is in the folded state.

If desired, jacket 10 can be provided with a small pocket 32 in the back of upper portion 21 beneath capelette 12 as illustrated in FIGS. 2, 3 and 8. Pocket 32 may be formed from conventional material suitable for garment pockets, or it may simply be formed by sewing a section of coat liner material (not shown) to the inside surface of the back of upper portion 21 in a pocket shaped pattern. In either case, pocket 32 will then be available as an accessible storage compartment when jacket 10 is converted into a folded jacket as shown in FIGS. 2 and 8, or as a hidden pocket when jacket 10 is in normal use as shown in FIG. 3. Zipper closure 34 may also be provided in accordance with conventional construction techniques.

It is noted that jacket 10, once folded, may also function as a cushion.

It is, of course, to be understood that the abovedescribed structure is merely illustrative and is in no way limiting of the invention as delineated by the claims appended below.

I claim:

1. A foldable jacket or coat comprising:

(a) a conventional jacket including an upper back portion;

(b) a capelette extending over said upper back portion having its upper and side edges attached to said upper back portion by reinforcing means so as to form with said upper back portion, while attached to said upper back portion and folded back upon itself, a pouch into which the remainder of the coat can be inserted upon being folded;

(c) fastening means affixed to the jacket on each side thereof on the back and in between the capelette and the upper back portion; and (d) strap means constructed and arranged to attach to said fastening means and to cooperate in length with the extent of the width of the folded jacket to encircle the body of the wearer.

2. A foldable jacket or coat comprising:

(a) a conventional jacket having an upper back portion;

(b) a capelette extending over said upper back portion having its upper and side edges attached to said upper back portion by reinforcing means so as to form with said upper backportion, while attached to said upper back portion and folded back upon itself, a pouch into which the remainder of the coat can be inserted when folded;

(c) fastening means affixed to the jacket on each side thereof of the back and in between the capelette and the upper back portion; and (d) strap means constructed and arranged to connect to the fastening means and together with the folded coat together being of a length sufficient to encircle the body of the wearer, said fastening means being attached to the coat midway between the upper and lower portions along the side of said capelette so that the folded coat when worn is supported against the back and positioned so that it bears equally above and below the line of support against the body of the wearer.

3. The foldable jacket as in either of claims 1 or 2 further in which any one of said strap means and fastening means provided with clip means and the other is provided with ring means for detachably engaging said clip means so that said strap is detachable from the jacket.

4. The foldable jacket of either of claims 1 or 2 further including connecting means attached to said foldable jacket in close proximity to said pouch means for facilitating the detachable attachment of said detachable strap means to said foldable jacket.

5. The foldable jacket of either of claims 1 or 2 wherein said fastening means includes a D-ring attached to said foldable jacket by a strip of material and wherein said detachable strap means includes an elongated piece of elastic material and a detachable clasp affixed to one end of said elongated piece of elastic material.

* * * * *